United States Patent [19]

Wang et al.

[11] 4,340,467

[45] Jul. 20, 1982

[54] FLOTATION OF COAL WITH LATEX EMULSIONS OF HYDROCARBON ANIMAL OR VEGETABLE BASED OIL

[75] Inventors: Samuel S. Wang, Cheshire; Michael J. Scanlon, Stratford, both of Conn.

[73] Assignee: American Cyanamid Company, Stamford, Conn.

[21] Appl. No.: 132,248

[22] Filed: Mar. 20, 1980

[51] Int. Cl.[3] ..... B03D 1/02

[52] U.S. Cl. ..... 209/166

[58] Field of Search ..... 209/166, 167; 252/61

[56] References Cited

U.S. PATENT DOCUMENTS

| | | | |
|---|---|---|---|
| 3,284,393 | 11/1966 | Vanderhoff | 260/29.6 HN |
| 3,624,018 | 11/1971 | Anderson | 260/29.6 H |
| 3,734,873 | 5/1973 | Anderson | 252/363.5 |
| 3,997,492 | 12/1976 | Kane | 260/29.6 HN X |
| 4,147,681 | 4/1979 | Lim | 260/29.6 H X |
| 4,162,966 | 7/1979 | Finch | 209/166 |
| 4,212,784 | 7/1980 | Phillips | 260/29.6 H X |

FOREIGN PATENT DOCUMENTS

| | | | |
|---|---|---|---|
| 121385 | 6/1958 | U.S.S.R. | 252/61 |

*Primary Examiner*—Robert Halper

*Attorney, Agent, or Firm*—Michael J. Kelly; Paul W. Leuzzi, II

[57] ABSTRACT

Employment of a latex emulsion prepared from a hydrocarbon, animal or vegetable based oil with a hydrophobic water-in-oil emulsifier and a hydrophilic surfactant in the froth flotation of coal improves coal recovery without increasing the ash content. The emulsifier employed should have an HLB value of 5.0 or less while the surfactant should have an HLB value of 9.0 or higher.

6 Claims, No Drawings

FLOTATION OF COAL WITH LATEX EMULSIONS OF HYDROCARBON ANIMAL OR VEGETABLE BASED OIL

BACKGROUND OF THE INVENTION

Coal is a solid, combustible mineral substance which, as a result of its natural coalification process, is generally associated with some non-combustible mineral matter, called ash. In conventional coal cleaning processes, such as coarse or intermediate gravity preparation, removal of the larger fragments of the inert material is highly successful whereas removal of the finer fragments intimately associated with the coal is largely inefficient.

Fine cleaning of the −28 Tyler mesh coal is currently accomplished by a process which integrates classification, cyclone washing and flotation. With the ever increasing concern over environmental problems associated with "black water" and the increase in the value of coal as an alternative energy source, the recovery of the fine coal through flotation techniques is becoming more prevalent in the industry as a whole.

It has long been known that coal possesses an inherent flotability. In the froth flotation of coal, coal is separated from its gangue in the form of a froth using gas as the buoyant medium. Since coal is flotable, the material generally may need only a nudge to float readily. Thus, the high rank bituminous coals frequently require only a frother. However, the intermediate to low rank bituminous coals may require from 1 to 3 pounds of hydrocarbon oil per ton of coal for good recoveries. Lignite further requires even larger dosages of hydrocarbon oil or more potent collectors to achieve good recovery. With the oxidized coals, large quantities of hydrocarbon oil and/or collectors are again necessitated to obtain the desired recoveries.

In an effort to increase recovery of the fine coal without increasing the amount of ash in the recovered product, various novel polymers have been suggested in the art. Frank F. Aplan reported in his article "Coal Flotation", *Flotation*, A. M. Gaudin Memorial Volume, Volume 2, The American Institute of Mining, Metallurgical, and Petroleum Engineers, Inc., New York, 1976, that emulsifying a fuel oil with a frother or a surfactant can lead to reduced reagent requirements in froth flotation of coal. M. Barcal and F. Dedek reported in "Emulsification of Flotation Agents for Coal", Acta Mont. 1974, No. 28, 59–91 that improved floatability was observed with a stabilized emulsion of a mineral oil through the addition of a foaming agent. Although both of these references teach the use of oil-in-water emulsion systems, they indicate that the recoveries achieved still lag behind industry expectations. More recently, U.S. Pat. No. 4,162,966, issued to Finch in July of 1979, disclosed that the employment of water-in-oil emulsions of a sodium polyacrylate latex as a flotation promotor for coal increased recoveries. The leading edge of innovation in this subject matter, therefore, requires employing, as a flotation promoter, a water-in-oil emulsion comprising a polymer latex, a paraffinic solvent, an emulsifier, an activator and a minor quantity of a stabilizer. The Finch emulsion promotor is not only commercially unattractive due to the high cost of the polymer, but has been shown to be indiscriminate and nonselective in its recovery strength resulting in a high ash recovery with the coal.

Accordingly, there exists the need for a more efficient and economic promoter capable of exhibiting high coal recoveries without associated ash. Accordingly, the provision for a more economical and efficient promoter would fulfill a long-felt need and constitute a major advance in the art.

SUMMARY OF THE INVENTION

The instant invention provides a froth flotation process comprising adding to an aqueous phase containing a coal and its associated ash (1) a frother, (2) a collector, (3) a frothing gas and optionally (4) a modifier; and thereafter recovering the coal that is froth floated, the improvement which comprises: adding a latex emulsion as the collector, said latex emulsion consisting essentially of from about 10% to 70% by weight of a hydrocarbon, animal or vegetable based oil, from about 1.0% to 18% by weight of a hydrophobic water-in-oil emulsion having an HLB value of not greater than 5.0, from about 0.1% to 7% by weight of a hydrophilic surfactant having a HLB value of not less than 9.0 and the remainder of the collector constituting water.

Economically, this process is substantially less costly than current processes in that it overcomes the necessity of employing expensive polymers to obtain the desired coal recoveries. Technically, this process is precise in the components necessary to achieve coal recoveries on a par with current industry standards. And commercially, this process achieves the excellent coal recoveries without associated high ash necessary to warrent its implementation.

DETAILED DESCRIPTION OF THE INVENTION

In accordance with the instant invention, there is provided a process for separating and recovering coal from its associated ash. The instant process exhibits especially superior results when the coal employed is a fine coal having a low rank, although the process is fully compatible with all coal types.

The flotation process entails adding to an aqueous phase containing the coal and its associated ash (1) a frother, (2) a collector, (3) a frothing gas and optionally (4) a modifier. Typical frothers useful herein, but which this invention is not limited to, include pine oil, creosote and cresylic acid, alcohols and various synthetic frothers. These frothers are generally characterized by their ability to provide a stable froth, persistent enough to facilitate the separation, yet not so persistent as to resist breaking down during subsequent handling. The frothing gas provides a froth upon its injection into the aqueous suspension containing the frother. Although air is the most common frothing gas employed, almost any gas will suffice with oxygen appearing particularly desirable. Modifiers are generally a class of compositions including pH regulators, activators, depressants, dispersants and flocculants. Modifiers may or may not be necessary in the flotation system depending upon the specifics of the system and the type of coal being processed. The collector increases the capacity of the froth formed to carry the coal sought to be floated and subsequently recovered in the froth.

The improvement over conventional coal flotation techniques is the employment of a latex emulsion as the collector wherein the latex emulsion consists essentially of from about 10% to 70% by weight of a hydrocarbon, animal or vegetable based oil preferably 50% to 70%, from about 1.0 to 18% by weight of a hydrophobic water-in-oil emulsifier having an HLB value of not greater than 5.0, preferably 1.0% to 7%, from about 0.1% to 7% by weight of a hydrophilic surfactant having an HLB value not less than 9.0, preferably 0.1% to 4%, and the remainder of the collector constituting water. The latex emulsion collector is preferably added as a prepared emulsion. Effective amounts of the latex emulsion may vary depending upon the coal being processed.

Suitable hydrocarbon oils include, but are not limited to, kerosine, fuel oil and low odor petroleum solvents; suitable animal or vegetable based oils include cottonseed oil, corn oil, sunflower oil, soybean oil, fish oil, livestock oil, and the like.

Suitable hydrophobic water-in-oil emulsifiers having an HLB value of not greater than 5.0 include, but are not limited to, the mono- and di-fatty esters of glycerol, sorbitan and polyethyleneglycols such as sorbitan tristearate, glycerol mono-oleate, glycerol monostearate, glycerol monolaurate and the like, and the nonionic emulsifiers such as ethoxylated fatty acids. Preferably, sorbitan mono-oleate is employed as the hydrophobic emulsifier. The HLB limitation of 5.0 or less is significant because an emulsifier with an HLB value above 5.0 will not lead to a water-in-oil emulsion system.

Suitable hydrophilic surfactants having an HLB value of not less than 9.0 include, but are not limited to, dialkylsulfosuccinates, ethoxylated alcohols, alkylacrylphenols, ethoxylated amines, acids and amides. Examples of these surfactants include: dioctylsulfosuccinate, octylphenoxy polyethoxy ethanol, nonylphenol ethoxylate, ethoxylated coco amine and the like. The HLB limitation of 9.0 or above is significant because a surfactant with a lower HLB value will break the water-in-oil emulsion into an oil-in-water emulsion by face inversion.

Whereas the exact scope of the present invention is set out in the appended claims, the following specific examples illustrate certain aspects of the present invention and, more particularly, point out methods of evaluating the flotation process. However, the examples are set forth for illustration only, and are not to be construed as limitations on the present invention except as set forth in the appended claims. All parts and percentages are by weight unless otherwise specified.

GENERAL PROCEDURE

A coal flotation feed was obtained from a West Virginia coal mine and found to be 5.1% +65 mesh, 8.3% +200 mesh and 66.3% −325 mesh. A feed slurry was prepared and divided into 2800 part aliquots for batch flotation.

Flotation was conducted on a Wemco 1+1 flotation cell. Appropriate reagents were added and the feed was allowed to condition for 30 seconds before flotation was commenced at 1000 rpm for four (4) minutes. The concentrate and tails recovered were filtered and dried at 52° C. Ash contents were determined and percent coal recovery calculated as follows:

$$\% \text{ coal recovery} = \frac{Wc \times (100 - Ac)}{[Wc \times (100 - Ac)] + [Wt \times (100 - At)]} \times 100$$

where

Wc and Wt = weight percent recovery of concentrate and tails, respectively

Ac and At = % ash content in concentrate and tails, respectively.

EXAMPLE 1

Following the General Procedure in every material detail wherein the feed ash content is 25% and the feed solids content in the flotation cell is 9.6%, the reagents listed in Table I are employed. Test results set forth therein indicate that the lowest ash content and highest recovery is obtained employing the latex emulsion.

TABLE I

| Reagent Dosage, lb./ton | | | | | | |
|---|---|---|---|---|---|---|
| Frother | Hydrocarbon Oil | Surfactant | Emulsifier | Emulsion | % Ash | % Coal Recovery |
| 0.5 | — | — | — | — | 9.2 | 70.4 |
| 0.5 | 0.5 | — | — | — | 8.4 | 83.4 |
| 0.5 | 0.195 | — | — | — | 9.81 | 74.8 |
| 0.5 | — | 0.02 | — | — | 9.52 | 74.2 |
| 0.5 | — | — | 0.01 | — | 9.32 | 74.7 |
| 0.5 | (0.195) | (0.02) | (0.01) | 0.50 | 8.5 | 85.8 |

Reagents Employed:
Frother - methylisobutylcarbinol
Hydrocarbon Oil - No. 2 Fuel Oil
Surfactant - dioctylsulfosuccinate, HLB = approximately 14.0
Emulsifier - sorbitan mono-oleate, HLB = 4.3
Emulsion - a latex emulsion containing 55% water, 39% No. 2 Fuel Oil, 2% sorbitan mono-oleate, and 4% dioctylsulfosuccinate. At 0.5 lb/ton, the emulsion contains the respective components shown above in parenthesis.

EXAMPLE 2

Following the General Procedure in every material detail wherein the feed ash content is 30% and the feed solids content is 5.3%, the reagents listed in Table II are employed. Test results set forth therein indicate that the lowest ash content and highest recovery is obtained employing the latex emulsion.

TABLE II

| FROTHER | HYDROCARBON OIL - A | EMULSIFIER | SURFACTANT | HYDROCARBON OIL - B | DRY POLYMER | EMULSION W/POLYMER | EMULSION W/O POLYMER | % ASH | % COAL RECOVERY |
|---|---|---|---|---|---|---|---|---|---|
| 0.25 | 0.25 | — | — | — | — | — | — | 8.3 | 80.5 |
| 0.25 | 0.25 | (0.019) | (0.039) | (0.054) | (0.4) | 1.2 | — | 18.9 | 94.7 |
| 0.25 | 0.25 | — | — | — | 0.4 | — | — | 16.6 | 86.8 |
| 0.25 | 0.25 | 0.019 | — | — | 0.4 | — | — | 15.3 | 87.1 |
| 0.25 | 0.25 | 0.019 | 0.039 | — | 0.4 | — | — | 16.7 | 87.0 |
| 0.25 | 0.25 | 0.019 | 0.039 | 0.54 | 0.4 | — | — | 17.9 | 92.8 |
| 0.25 | 0.25 | (0.019) | (0.039) | (0.54) | — | — | 0.8* | 11.5 | 93.0 |
| 0.50 | 0.50 | — | — | — | — | — | — | 10.5 | 93.8 |
| 0.50 | — | (0.01) | (0.02) | (0.195) | — | — | 0.5** | 10.3 | 95.0 |

Reagents Employed:
Frother — methylisobutylcarbinol
Hydrocarbon Oil A — No. 2 Fuel Oil
Hydrocarbon Oil B — Low odor petroleum solvent
Emulsifier — Sorbitan monooleate, HLB = 4.3

TABLE II-continued

| FROTHER | HYDRO-CARBON OIL - A | EMUL-SIFIER | SUR-FAC-TANT | HYDRO-CARBON OIL - B | DRY POLYMER | EMULSION W/POLYMER | EMULSION W/O POLYMER | % ASH | % COAL RECOVERY |
|---|---|---|---|---|---|---|---|---|---|
| | | Surfactant | | ethoxylated nonylphenol, HLB = 10.0 | | | | | |
| | | Dry Polymer | | sodium acrylate polymer precipitated from eulsion polymer, Standard Viscosity = 3.4 based on acrylic acid | | | | | |
| | | Emulsion Polymer | | an invertable sodium acrylate latex emulsion, 29% active polymer, Standard Viscosity = 3.4 based on acrylic acid, containing the respective components shown above in parentheses. | | | | | |
| | | Emulsion* | | latex emulsion containing 25.2% water, 67.5% low odor petroleum solvent, 2.4% sorbitan mono-oleate and 4.9% ethoxylated nonylphenol. At 0.8 lb/ton, the emulsion contains the respective components shown above in parentheses. | | | | | |
| | | Emulsion** | | latex emulsion containing 55% water, 39% low odor petroleum solvent, 2% sorbitan mono-oleate and 4% ethoxylated nonylphenol. At 0.5 lb/ton, the emulsion contains the respective components shown above in parentheses. | | | | | |

EXAMPLE 3

When the procedure of Example 1 is followed employing as the collector a latex emulsion comprising 68% by weight of kerosine, 23% by weight of an alkylaryl polyether ethanol with an HLB value of 9.1 and 9% by weight of an ethoxylated castor oil having an HLB value of 3.6 substantially equivalent results are obtained.

EXAMPLE 4

When the procedure of Example 1 is followed employing as the collector a latex emulsion comprising 76% by weight of corn oil, 18% by weight of a nonylphenoxy polyethoxyethanol having an HLB value of 11.7 and 6% by weight of an ethoxylated castor oil having an HLB value of 4.9, substantially equivalent results are obtained.

EXAMPLE 6

When the procedure of Example 1 is followed employing as the collector a latex emulsion comprising 92% by weight low odor petroleum solvent, 4% by weight of an alkylaryl polyethylene glycol ether having an HLB value of 14.1 and 4% by weight of a glycerol mono-oleate having an HLB value of 3.4, substantially equivalent results are obtained.

EXAMPLE 7

Following the General Procedure in every material detail wherein the feed ash content is 28% and the feed solids content is 11.0%, the reagents listed in Table III are employed. Test results set forth herein indicate that the lowest ash content and highest recoveries are obtained employing a latex emulsion without any polymer.

TABLE III

| Frother | Hydro-carbon Oil A | Hydro-carbon Oil B | Emul-sifier | Sur-factant | Dry Polymer | Polymer Emulsion | Latex Emul-sion A | Latex Emul-sion B | % Wt. Rec. | % Ash | % Coal Re-covery | Remarks |
|---|---|---|---|---|---|---|---|---|---|---|---|---|
| 0.4 | 0.6 | — | — | — | — | — | — | — | 75.4 | 10.4 | 94.5 | — |
| 0.4 | — | — | — | — | — | 0.6 | — | — | 73.3 | 11.1 | 90.23 | Reagents Emulsified |
| 0.4 | — | — | — | — | — | — | 0.6 | — | 77.6 | 10.7 | 95.3 | " |
| 0.3 | — | — | — | — | — | — | 0.6 | — | 76.1 | 10.2 | 94.6 | " |
| 0.4 | — | — | — | — | — | — | — | 0.6 | 78.2 | 10.2 | 95.9 | " |
| 0.4 | — | 0.27 | 0.0095 | 0.0195 | 0.2 | — | — | — | 68.07 | 9.9 | 88.01 | Reagents not Emulsified |
| 0.4 | — | 0.27 | 0.0095 | 0.0195 | — | — | — | — | 68.37 | 9.8 | 86.62 | " |

| Reagents Employed: | | |
|---|---|---|
| | Frother | methylisobutylcarbinol |
| | Hydrocarbon Oil A | No. 2 Fuel Oil |
| | Hydrocarbon Oil B | low odor petroleum solvent |
| | Emulsifier | sorbitan mono-oleate, = 4.3 |
| | Surfactant | ethoxylated nonylphenol, HLB = 10.0 |
| | Dry Polymer | ammonium polyacrylate, Standard Viscosity = 3.4 based on acrylic acid |
| | Polymer Emulsion | an invertable sodium polyacrylate latex emulsion, 30% active polymer, Standard Viscosity = 3.4 based on acrylic acid, containing 0.0095 emulsifier, 0.0195 surfactant 0.18 polymer, 0.27 low odor petroleum solvent and 0.121 water. |
| | Latex Emulsion A | a latex emulsion containing 39% kerosine, 2% sorbitan mono-oleate, 4% ethoxylated nonylphenol and 55% water |
| | Latex Emulsion B | a latex emulsion containing 39% kerosine, 2% sorbitan mono-oleate, 4% dioctyl sulfosuccinate and 55% water. |

EXAMPLE 5

When the procedure of Example 1 is followed employing as the collector a latex emulsion comprising 84% by weight of fish oil, 14% by weight of a tall oil ethoxylate having an HLB value of 12.3 and 2% by weight of a modified glycerol mono-oleate with an HLB value of 2.8 substantially equivalent results are obtained.

We claim:

1. In a froth flotation process comprising adding to an aqueous phase containing a coal and its associated ash (1) a frother, (2) a collector, (3) a frothing gas and optionally (4) a modifier and thereafter recovering the coal that is froth floated, the improvement which comprises:

adding a latex emulsion as the collector, said latex emulsion consisting essentially of from about 10% to 70% by weight of a hydrocarbon, animal or vegetable based oil, from about 1.0% to 18% by weight of a hydrophobic water-in-oil emulsifier having an HLB value of not greater than 5.0, from about 0.1% to 7% by weight of a hydrophilic surfactant having an HLB value of not less than 9.0 and the remainder constituting water.

2. The process of claim 1 wherein the latex emulsion consists essentially of about 50% to 70% by weight of the hydrocarbon oil, 1.0% to 7% by weight of the hydrophobic emulsifier, 0.1% to 4% by weight of the hydrophilic surfactant and the remainder constituting water.

3. The process of claim 1 wherein the hydrocarbon oil is a low odor petroleum solvent.

4. The process of claim 1 wherein the hydrophobic emulsifier is sorbitan mono-oleate.

5. The process of claim 1 wherein the hydrophilic surfactant is ethoxylated nonylphenol.

6. The process of claim 1 wherein the hydrophilic surfactant is dioctylsulfosuccinate.

* * * * *